US009763556B2

(12) United States Patent
Kåberg et al.

(10) Patent No.: US 9,763,556 B2
(45) Date of Patent: Sep. 19, 2017

(54) CUTLERY RACK

(71) Applicant: ELECTROLUX HOME PRODUCTS CORPORATION N. V., Brussels (BE)

(72) Inventors: Pontus Kåberg, Sollentuna (SE); Rickard Hederstierna, Lund (SE); Daniel Mesa, Stockholm (SE)

(73) Assignee: Electrolux Home Products Corporation N.V., Brussels (BE)

( * ) Notice: Subject to any disclaimer, the term of this patent is extended or adjusted under 35 U.S.C. 154(b) by 0 days.

(21) Appl. No.: 14/653,181

(22) PCT Filed: Dec. 21, 2012

(86) PCT No.: PCT/EP2012/076755

§ 371 (c)(1),
(2) Date: Jun. 17, 2015

(87) PCT Pub. No.: WO2014/094893

PCT Pub. Date: Jun. 26, 2014

(65) Prior Publication Data

US 2015/0327749 A1 Nov. 19, 2015

(51) Int. Cl.
*A47L 15/50* (2006.01)

(52) U.S. Cl.
CPC ..... *A47L 15/502* (2013.01); *A47L 15/503* (2013.01); *A47L 15/505* (2013.01); *A47L 15/504* (2013.01)

(58) Field of Classification Search
CPC .... A47L 15/502; A47L 15/503; A47L 15/504; A47L 15/505; A47L 15/507
See application file for complete search history.

(56) References Cited

U.S. PATENT DOCUMENTS

| | | | |
|---|---|---|---|
| 1,484,291 | A | 2/1924 | Blakeslee |
| 1,691,858 | A | 11/1928 | Ryerson |
| 1,714,266 | A | 5/1929 | Ernest |
| 2,600,096 | A | 6/1952 | Cooper et al. |

(Continued)

FOREIGN PATENT DOCUMENTS

| | | |
|---|---|---|
| CN | 1610515 | 4/2005 |
| CN | 2889155 | 4/2007 |

(Continued)

OTHER PUBLICATIONS

European Search Report for Application No. EP 09 01 1294 dated Feb. 3, 2010.

(Continued)

*Primary Examiner* — Leslie A Nicholson, III
*Assistant Examiner* — Kimberley S Wright
(74) *Attorney, Agent, or Firm* — Alston & Bird LLP

(57) ABSTRACT

The present invention relates to a cutlery rack (21; 41) for a dishwasher (10). The cutlery rack comprises: a support frame (23; 43) surrounding a storage area for the cutleries; a rack bottom (25; 45) with a first and a second side; a first support arrangement (29; 48) for cutleries arranged on said first side of the rack bottom; and a second support (49) arrangement for cutleries arranged on said second side of the rack bottom, wherein the cutlery rack is arranged with either the first or second side of the rack bottom facing upwards. The invention furthermore relates to a dishwasher (10) comprising at least one cutlery rack (21; 41) as defined above.

20 Claims, 5 Drawing Sheets

(56) References Cited

U.S. PATENT DOCUMENTS 3,568,848 A 3/1971 Tzifkansky
3,887,102 A 6/1975 Earley
3,935,958 A 2/1976 Frangos
4,046,261 A * 9/1977 Yake ..... A47L 15/505 211/184
4,372,448 A 2/1983 Drach
4,564,118 A 1/1986 Heyer et al.
5,016,772 A 5/1991 Wilk
5,083,827 A 1/1992 Hollenbaugh, Sr.
5,086,544 A 2/1992 Huttemann
5,431,294 A 7/1995 Stottmann et al.
5,462,348 A 10/1995 Ellingson et al.
5,601,195 A * 2/1997 Finola ..... A47L 15/503 211/41.8
5,626,242 A 5/1997 Weizer
5,881,906 A 3/1999 Rogers et al.
6,125,548 A * 10/2000 Dunn ..... F26B 25/18 211/41.6
6,467,622 B1 10/2002 Hull
6,848,585 B2 * 2/2005 VanLandingham ... A47L 15/504 211/41.8
6,945,421 B2 9/2005 Phifer
7,231,929 B2 * 6/2007 Landsiedel ..... A47L 15/503 134/135
7,445,128 B2 11/2008 Kaczmarek
7,455,066 B2 11/2008 Feddema et al.
7,458,473 B1 12/2008 Mason
7,464,827 B2 12/2008 Meissen
7,478,642 B2 1/2009 Koch et al.
7,493,905 B2 * 2/2009 Jeong ..... A47L 15/502 134/56 D
7,862,664 B2 1/2011 Choi et al.
7,931,155 B2 * 4/2011 Bastuji ..... A47L 15/503 134/56 D
8,163,103 B2 4/2012 Shin et al.
RE43,349 E * 5/2012 Dunn ..... F26B 25/18 211/41.6
8,191,560 B2 6/2012 Mallory et al.
8,196,593 B2 * 6/2012 Schessl et al. ..... 134/135
8,303,725 B2 11/2012 Crookshanks et al.
8,353,412 B2 1/2013 Rosenbauer et al.
8,356,719 B2 * 1/2013 Haltmayer ..... A47L 15/503 211/41.8
D683,504 S 5/2013 Clores
8,522,998 B2 9/2013 Crookshanks et al.
8,540,085 B2 9/2013 Klump et al.
8,646,620 B2 * 2/2014 Klump ..... A47L 15/50 211/41.8
8,651,287 B2 * 2/2014 Moser ..... 211/175
8,746,467 B2 6/2014 Jeong
8,794,455 B2 * 8/2014 Yang ..... A47L 19/04 211/41.3
8,858,725 B2 10/2014 Mailander
D725,325 S 3/2015 Lee et al.
D725,851 S 3/2015 Lee et al.
9,107,552 B2 * 8/2015 Micek ..... A47L 19/04
9,119,493 B2 9/2015 Jeong
9,119,524 B2 9/2015 Renz et al.
2003/0089672 A1 * 5/2003 VanLandingham ... A47L 15/503 211/41.8
2004/0079713 A1 4/2004 Wendt et al.
2005/0109378 A1 * 5/2005 Landsiedel ..... A47L 15/503 134/135
2005/0167374 A1 8/2005 Yang et al.
2005/0178412 A1 8/2005 Koch et al.
2005/0241682 A1 * 11/2005 Jeong ..... A47L 15/502 134/56 D
2006/0113260 A1 6/2006 Purushothaman et al.
2006/0219271 A1 10/2006 Feddema et al.
2006/0243681 A1 11/2006 Bastuji et al.
2006/0250058 A1 11/2006 Stevens et al.
2007/0039636 A1 2/2007 Egger et al.
2007/0039904 A1 * 2/2007 Purushothaman ..... 211/41.8
2007/0090063 A1 4/2007 Schmidt
2007/0119801 A1 5/2007 Miele et al.
2008/0072937 A1 3/2008 Choi et al.
2008/0110480 A1 5/2008 Choi et al.
2008/0156358 A1 7/2008 Shin et al.
2008/0156362 A1 7/2008 Shin et al.
2008/0169009 A1 7/2008 Mailander
2008/0302740 A1 * 12/2008 Moser ..... A47L 15/503 211/41.8
2009/0038657 A1 2/2009 Kang
2009/0140619 A1 6/2009 Buehlmeyer et al.
2009/0211994 A1 * 8/2009 Yang ..... A47L 19/04 211/41.4
2010/0051069 A1 3/2010 Schessl et al.
2010/0117498 A1 5/2010 Leinmuller et al.
2010/0155280 A1 6/2010 Graute
2010/0314977 A1 12/2010 Mallory et al.
2011/0018410 A1 1/2011 Bastuji et al.
2011/0193457 A1 8/2011 Bastuji
2011/0247990 A1 * 10/2011 Chai ..... 211/150
2011/0253650 A1 * 10/2011 Renz et al. ..... 211/41.9
2012/0139400 A1 6/2012 Hofpeter et al.
2012/0181242 A1 7/2012 Jeong
2012/0292269 A1 11/2012 Klump et al.
2013/0002107 A1 1/2013 Paschini et al.
2013/0319172 A1 * 12/2013 Uhl ..... F16C 9/00 74/579 R
2014/0190528 A1 7/2014 Wegener et al.
2014/0263111 A1 * 9/2014 Micek ..... A47L 19/04 211/41.6
2015/0182104 A1 7/2015 Jeong et al.
2015/0196189 A1 7/2015 Shaffer et al.
2015/0245761 A1 9/2015 Zhou et al.
2015/0335225 A1 11/2015 Seu

FOREIGN PATENT DOCUMENTS

CN 101563016 A 10/2009
CN 101917894 12/2010
DE 1 917 909 U 6/1965
DE 7008981 U 7/1970
DE 7032937 U 12/1970
DE 2 701 879 7/1978
DE 3 534 897 4/1987
DE 43 09 915 A1 9/1994
DE 195 40 611 A1 5/1997
DE 299 01 901 U1 6/2000
DE 10 353 725 6/2005
DE 10 2008 062761 3/2010
DE 10 2010 042 409 4/2012
DE 10 2011 081 774 2/2013
EP 0 186 157 7/1986
EP 0186157 * 7/1986
EP 1 072 221 A1 1/2001
EP 1275336 1/2003
EP 2 272 416 1/2011
EP 2272416 A2 * 1/2011
EP 2 377 455 10/2011
EP 2 478 820 7/2012
EP 2 554 097 2/2013
EP 2865316 A1 4/2015
ES 2 168 937 A1 6/2002
FR 2643809 A1 9/1990
GB 2 042 147 A 9/1980
GB 2419083 4/2006
JP 59 174154 11/1984
JP S62-61673 U 4/1987
JP 63 095573 6/1988
JP 64 028259 2/1989
JP 10-328117 A 12/1998
JP 2002345578 12/2003
WO WO 03/055375 A1 7/2003
WO WO 03/055376 A1 7/2003
WO WO 04/000090 A1 12/2003
WO WO 2005/037051 A1 4/2005
WO WO 2005/041744 A1 5/2005
WO WO 2006/056515 A1 6/2006
WO WO 2008/035866 A1 3/2008
WO WO 2008/061869 A1 5/2008

(56) References Cited

FOREIGN PATENT DOCUMENTS

OTHER PUBLICATIONS

European Search Report for Application No. EP 10 00 2618 dated Jul. 19, 2010.
International Search Report and Written Opinion for International Application No. PCT/EP2010/005252, mailed Dec. 14, 2010.
International Search Report for Application No. PCT/EP2011/001202, dated Jan. 25, 2012.
Written Opinion for Application No. PCT/EP2011/001202, dated Jan. 25, 2012.
Written Opinion for Application No. PCT/EP2012/076755, dated Feb. 27, 2013.
Written Opinion for Application No. PCT/EP2012/076761, dated Sep. 3, 2013.
Letter received from Louis Pohlau Lohrentz regarding Opposition against EP 2 364 636 B1 of Electrolux Home Products Corporation; VII. Indication of Facts and Evidence as to Grounds on Which the Opposition is Based Pursuant to Rule 75(2)(c) EPC, dated Mar. 19, 2014, 14 pages.
Notice of Opposition to a European Patent (EP 2364636) dated Mar. 29, 2014, 5 pages.
Office Action for European Application No. EP 09 011 294.7 dated Feb. 1, 2013.
International Search Report for PCT/EP2012/076755; dated Feb. 27, 2013.
International Search Report for PCT/EP2012/076761; dated Sep. 3, 2013.
Advisory Action for U.S. Appl. No. 14/653,178 dated May 31, 2016.
Office Action for U.S. Appl. No. 14/653,178 dated Jun. 14, 2016, 13 pages.
Statement Regarding the Opposition of European Patent No. 2364636 dated May 12, 2016 for U.S. Appl. No. 13/583,762.
Office Action for U.S. Appl. No. 14/653,178 dated Mar. 2, 2016.
Letter from Louis Pohlau Lohrentz regarding Opposition Against EP 2 364 636 B1 of Electrolux Home Products Corp, N.V. in response to Patentees Letter of Aug. 26, 2013 introducing documents (dated Mar. 23, 2016.
Notice of Allowance for U.S. Appl. No. 13/583,762 dated Apr. 11, 2016.
Intention to Grant European Application No. 12 815 702.1 dated Sep. 6, 2016.
Notice of Appeal and Opposition Document Records for EP 3364636 dated Jun. 20, 2016 through Aug. 23, 2016.
Rule 71(3) Communication of Intent to Grant Patent for corresponding European Patent Application No. 12 815 702.1 dated Sep. 6, 2016, 7 pages.
Office Action for Chinese. Application No. 201280077769.2 dated Dec. 23, 2016.
Office Action for Chinese Application No. 201280077772.4 dated Feb. 22, 2017.

* cited by examiner

CUTLERY RACK

CROSS-REFERENCE TO RELATED APPLICATION

This application is a national stage entry of PCT/EP2012/076755 filed Dec. 21, 2012, which application is incorporated by reference herein in its entirety.

FIELD OF THE INVENTION

The present invention relates to a cutlery rack, and a dishwasher comprising said cutlery rack.

BACKGROUND OF THE INVENTION

Dishwashers are frequently used household machines in order to facilitate the daily work in private homes and restaurants. Dishwasher for use in households comprises a washing chamber that is accessed via an opening in the front side of the dishwasher. The opening is closed by a door. Dirty items are arranged in the washing chamber, for example in baskets, and when the dishwasher is activated sprayed by water that is circulated in the washing chamber.

Since the space within the washing chamber is limited, baskets and/or racks are arranged in the washing chamber in order to make it possible to arrange a number of plates, pots, glasses, and cutleries etc in the washing chamber for simultaneous dishing in the dishwasher. However, the storing baskets and/or racks are provided with support arrangements that intend to maintain the different items in the intended position, and prevent the items from falling and in worst case break. Unfortunately, these arrangements make it difficult to fit items with a different size or shape than the intended items that the arrangement is designed for.

One type of cutlery tray is disclosed in US2007/0119801. The disclosed tray is however intended to facilitate packing and unpacking of items to and from the tray and does not provide any possibility to adapt the tray for different types of items.

There is consequently a need for a storage and stacking device that is adaptable to differently sized and shaped items for dishing within the dishwasher.

SUMMARY OF THE INVENTION

The present invention, defined in the appended claims, provides a cutlery rack that, to at least some extent, fulfils the needs defined above.

The cutlery rack according to the invention comprises:

- a support frame surrounding a storage area for the cutleries;
- a rack bottom with a first and a second side;
- a first support arrangement for cutleries arranged on said first side of the rack bottom; and
- a second support arrangement for cutleries arranged on said second side of the rack bottom; wherein the cutlery rack is arranged with either the first or second side of the rack bottom facing upwards The claimed cutlery rack fulfils the needs defined above since the rack could be arranged with either the first or second side facing upwards. The two sides of the rack are adapted for different types and sizes of cutleries and thereby increase the flexibility of the rack in a simple and reliable way.

In one embodiment of the cutlery rack, the support frame has a vertical centre and the rack bottom is arranged in the support frame offset the vertical centre. This structurally very simple embodiment of the cutlery rack makes it possible to select the packing space between the rack bottom and washing chamber top surface above the cutlery rack and the usable space below the cutlery rack by selecting which side of the rack bottom that is facing upwards.

In one embodiment of the cutlery rack, the rack bottom is movably arranged along a vertical direction within the support frame between a first and a second position. The vertically movable rack bottom ensures that the space between the side of the rack bottom facing upwards and the top wall of the washing chamber, or a second rack arranged above the rack according to the invention is large enough to pack the dirty cutleries within the rack, and that the space within the washing chamber is used in an effective way since the rack could be arranged higher up within the washing chamber and still ensure the desired space within the cutlery rack independently of which side and support arrangement that is facing upwards.

In one embodiment of the invention, the rack bottom is attached in the support frame by guiding means and positioned in the lower position by gravity. This is a structurally simple design of the cutlery rack that ensures the desired functionality. Furthermore, this embodiment of the rack is extremely simple for the operator to use since the rack bottom automatically is arranged in the lower position when the side of the rack facing upwards is changed.

In one embodiment of the invention, each of the guiding means comprises an elongated slot and a corresponding protrusion that is able to slide within the slot, said slot and protrusion are arranged in different ones of the support frame or the rack bottom. This embodiment of the guiding means provides a simple and reliable arrangement.

In one embodiment of the invention, the first and second support arrangements are retractably arranged in the support frame or rack bottom and movable between a protruding position and a retracted position. This embodiment is advantageous since the retracted support arrangement on the side of the rack bottom facing downwards makes it possible to use the space below the cutlery rack in a more efficient way for other items such as plates, glasses, pots etc, alternatively make it possible to lower the position of the cutlery rack in the dishwasher and increase the space above the cutlery rack.

In one embodiment of the invention, the first and second support arrangements are extending from an elongated member turnable around a longitudinal axis (L) of the elongate member substantially parallel to the rack bottom (45. This embodiment of the support arrangements could be designed and manufactured in a simple and efficient way and still ensure the desired functionality of the retractable support arrangements.

In one embodiment of the invention, the first and second support arrangements are turnable to an upright position when the support arrangement is facing upwards and a retracted position substantially parallel to the surface of the rack bottom when the support arrangement is facing downwards.

In one embodiment of the invention, turning means are arranged in at least one end of the elongated member, said turning means comprising an arc-shaped slot arranged in the support frame and a turning member connected to the elongated member, said turning member is sliding within the arc-shaped slot such that the elongated member is forced to turn when the cutlery rack is turned upside down.

In one embodiment of the invention, the first and second support arrangement have different configuration to support different types and sizes of cutleries in order to increase the flexibility of the rack.

In one embodiment of the invention, the first and/or second support arrangement comprises support elements arranged at a predetermined distance from each other and extending in a substantially vertical direction from the rack bottom.

In the embodiment of the invention where the first and second support arrangement are retractably arranged in the cutlery rack, the first and/or second support arrangement comprises support elements arranged at a predetermined distance from each other and extending in a substantially vertical direction when in the protruding position.

In one embodiment of the invention, selected support elements are made of an elastic material to be able to adapt to cutleries, or kitchen tools, of different sizes and shapes.

In one embodiment of the invention, the support frame comprises an inside and an outside, said rack bottom is arranged on the inside surface of the frame and a number of protruding support devices extending from the outside surface of the support frame. The support devices are intended to rest against the rack support to maintain the cutlery rack in the intended horizontal position within the rack support. The support devices preferably has an upper and lower support surface such that the same support devices are usable independently of which side of the cutlery rack that is facing upwards.

The present invention furthermore relates to a dishwasher comprising at least one cutlery rack according to anyone of the previous claims arranged in a rack support extractable arranged in the dishwasher.

The different embodiment described above could of course be combined and modified in different ways without departing from the scope of the invention that will be described more in detail in the detailed description.

BRIEF DESCRIPTION OF THE DRAWINGS

Different embodiments of a cutlery rack according to the present invention are schematically illustrated in the appended figures.

DETAILED DESCRIPTION

Figure 1:
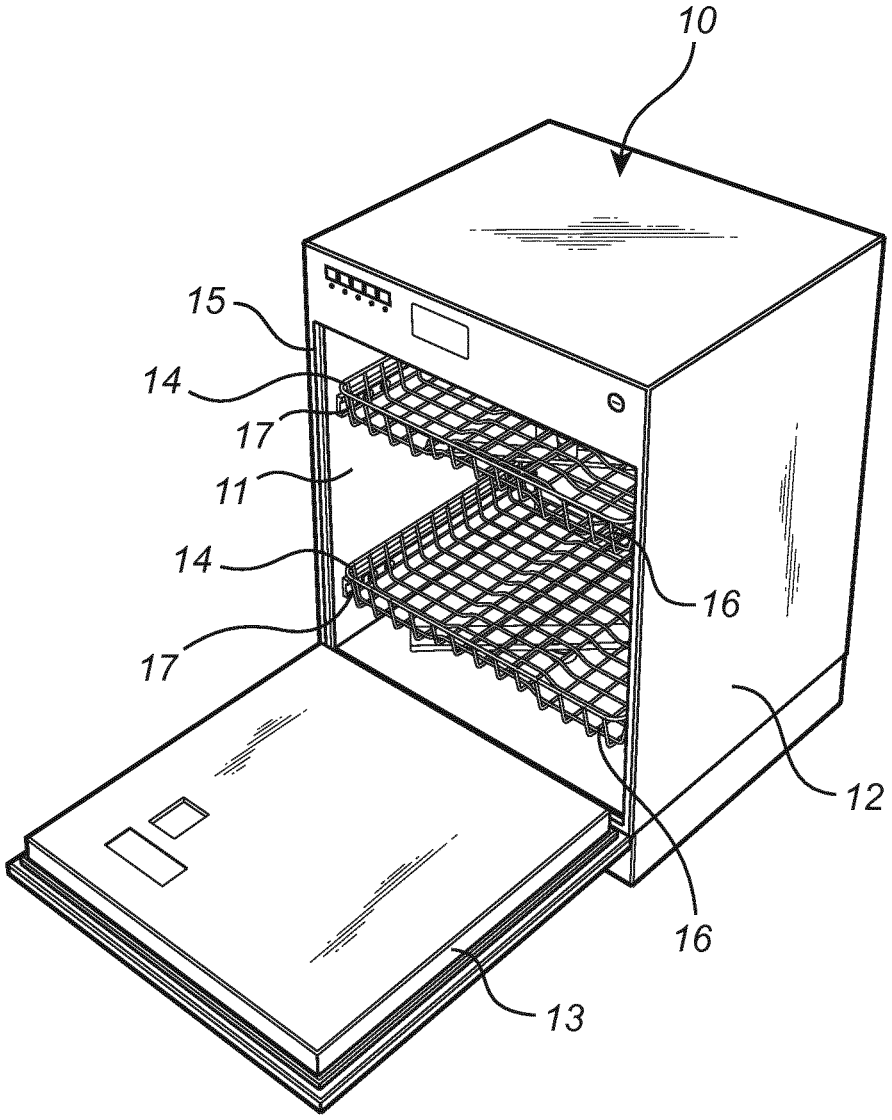
FIG. 1 illustrates a perspective schematic view of a dishwasher.

In FIG. 1, a perspective schematic view of dishwasher 10 is illustrated. The dishwasher comprise a washing chamber 11 surrounded by a substantially rectangular cabinet 12. The washing chamber 11 comprises an opening 15 in the front side of the dishwasher in order to make the washing chamber 11 accessible during loading and unloading of items in and from the washing chamber. The opening 15 is closed by a door 13 in order to make it possible to access, and close, the opening 15 of the washing chamber 11. Within the washing chamber 11, two or more extractable wire baskets 16 for dirty items are arranged at different heights. The dishwasher 10 illustrated in FIG. 1 comprises two wire baskets 16. The upper one is arranged on guide rails 17 to be easily extractable during packing and unpacking of the basket while the lower one normally is sliding on the inside of the opened door 13. The lower one is normally used for plates, pots etc, and the upper one for cups, glasses and smaller items.

The dishwasher could furthermore comprise a third extractable basket 20 in the form of a rack arranged in the top part of the washing chamber. The rack 20 is intended for cutleries, small items and different types of kitchen tools and is not illustrated in FIG. 1. However, one embodiment of the rack 20 is illustrated separately in FIG. 2.

The rack 20 is arranged on similar guiding rails as the upper basket 16 to be extractable to a position outside the washing chamber to facilitate packing and unpacking of items in and from the rack. However, the size and position of the two baskets and the rack could be changed in a number of ways in order to adapt the dishwasher to different users needs.

When the different dirty items are loaded in the baskets 16 and the cutlery rack 21, the dishwasher is activated, the selected washing program is started and heated water in combination with detergent are circulated in the washing chamber 11 by a water circulating system in order to clean the dirty items in the baskets and the cutlery rack.

Figure 2:
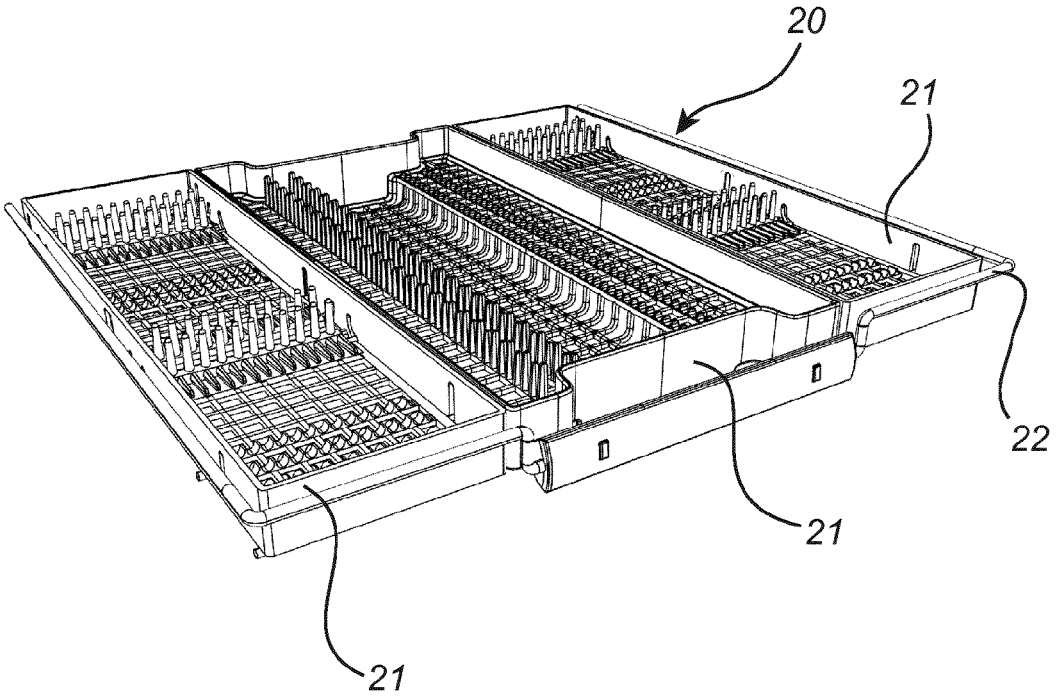
FIG. 2 illustrates a perspective view of a rack for use in a dishwasher.

In FIG. 2, one embodiment of the rack 20 intended to be arranged in the top part of the dishwasher is illustrated. The illustrated rack 20 comprises three different cutlery racks 21 arranged side by side within a rectangular rack support 22 that is extractably arranged within the washing chamber. The rectangular rack support 22 has a size corresponding to the available space within the washing chamber 11 in order to provides as large storage area as possible within the rack 20. The illustrated rack support is formed of wires but a number of different materials and designs could be used as long as the desired support for the cutlery racks is achieved. The interior design of the storage area of the three cutlery racks could be adapted for different types of cutleries, alternatively have a similar configuration depending on the user's needs. In the illustrated embodiment the two smaller cutlery racks have a similar configuration while the one in the middle is adapted for another type of cutleries. Furthermore, the number and size of the cutlery racks of the rack could be changed in different ways to adapt the rack to different types and sizes of cutleries and kitchen tools.

Figure 3A:
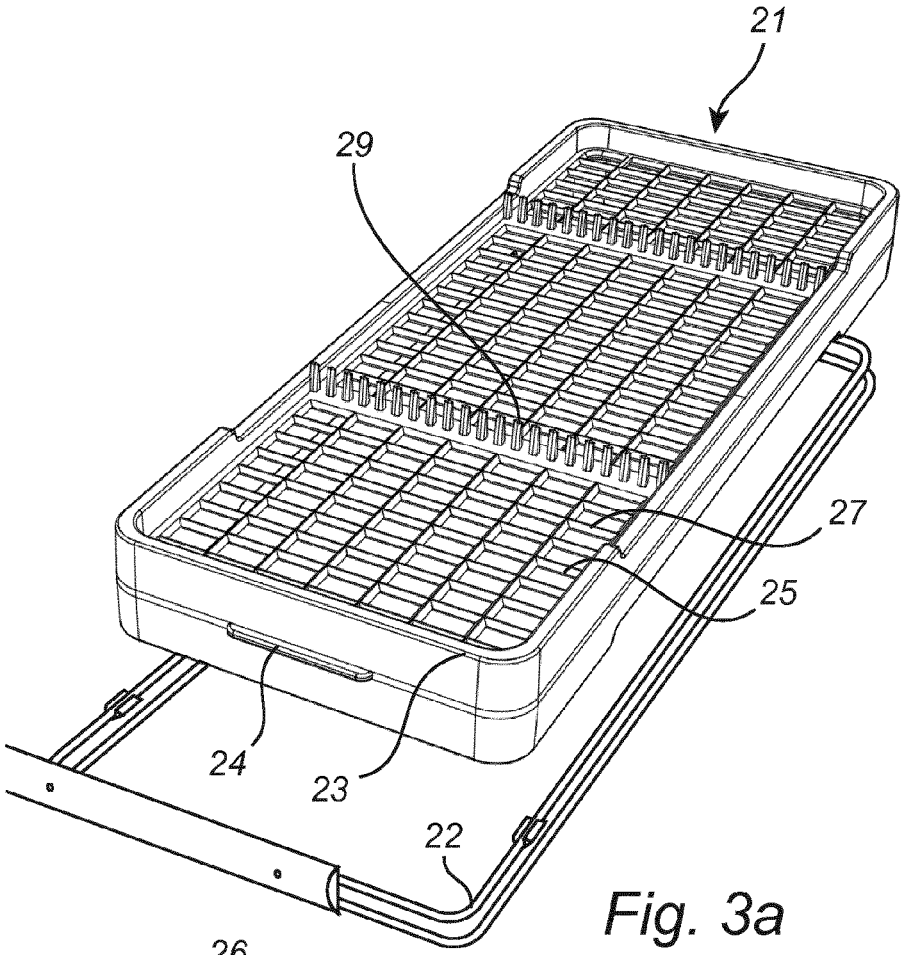
FIG. 3*a* illustrates a perspective view of a first embodiment of a cutlery rack.
Figure 3B:
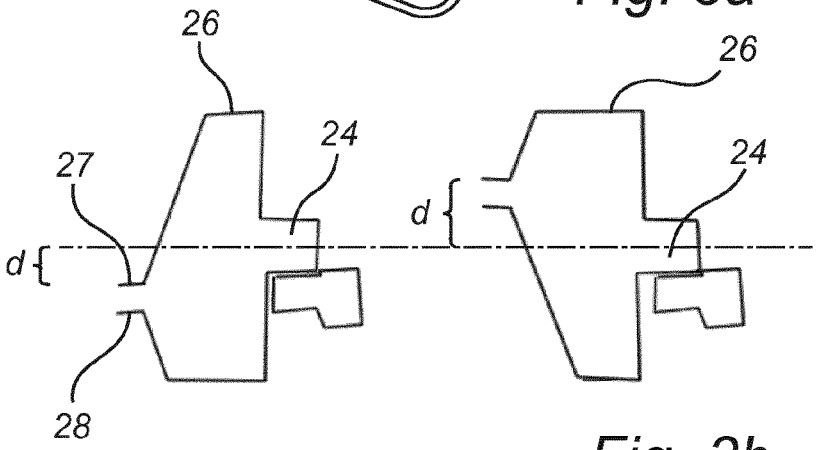
FIG. 3*b* illustrates two cross-sectional views through the support frame of the cutlery rack in FIG. 3*a*.

One embodiment of a cutlery rack 21 according to the present invention is illustrated in FIGS. 3*a* and 3*b*. The cutlery rack 21 is illustrated elevated from the other cutlery racks 21 and the rack support 22. The illustrated cutlery rack comprises a surrounding support frame 23 designed to fit within the rack support of the dishwasher. The cutlery rack is maintained within the rack support by a number of protruding support devices 24 that extend from the outside surface of the support frame. The cutlery rack furthermore comprises a substantially flat rack bottom 25 arranged within the support frame 23. The rack bottom 25 has a first 27 and a second 28 surface and is designed as a net with large openings to ensure that the circulating water for cleaning the items in the cutlery rack as well as removed debris is allowed to flow through the openings in the rack bottom and exit the cutlery rack. Several different patterns of the openings in the rack bottom 25 are possible as long as the desired properties are ensured. The rack bottom 25 is arranged a distance d from the vertical centre v of the support frame 23 such that the distance from the rack bottom 25 to the top surface of the top edge 26 of the support frame, and the top surface of the washing chamber 11, is different depending on which side of the rack bottom that is facing upwards. The cutlery rack 21 furthermore comprises a first 29 and a second support arrangement, not illustrated, arranged on corresponding opposite sides 27, 28 of the rack bottom 25. The first 29 and second support arrangement both comprises tines arranged in rows extending between opposite sides of the rectangular support frame 23 substantially parallel to the side surfaces of the rectangular support frame 23, The number of rows could be increased if further support is desired. The tines are arranged at a predetermined distance from each other and extend in substantially vertical direction from the rack bottom 25. The first 29 and the second support arrangement are adapted to different types and sizes of cutleries and kitchen tools in order to facilitate the packing of the cutleries within the cutlery rack and maintain the items in the intended position separated from each. The available space within the cutlery rack as well as the type of support arrangement could thereby be changed by changing the side of the rack bottom that is facing upwards. The illustrated cutlery rack comprises one row of A further improved embodiment of the cutlery rack 41, illustrated in FIG. 4, comprises a rectangular surrounding support frame 43 similar to the one described above. The support frame is designed to fit within the rectangular rack support 22 of the dishwasher 10. The cutlery rack 41 is maintained within the rectangular rack support 22 by protruding support devices that extend from the outside surface of the support frame, alternatively rack elements arranged on the rack support to maintain the cutlery rack 41 in the desired vertical direction of the rack support 22.

The cutlery rack 41 furthermore comprises a substantially flat rack bottom 45 arranged within the support frame 43. The rack bottom 45 is movably arranged in the support frame 43 between a first and a second position. The first and second positions are arranged at different positions along the vertical direction of the cutlery rack 41 when the cutlery rack 41 is arranged horizontally in the dishwasher 10 as intended. The cutlery rack 41 comprises a number of guiding means 34 arranged to support the rack bottom 45 during the movement from one position to the other. Each guiding means 34 comprises a protrusion 36 arranged at selected positions around the rack bottom 45 to provide the desired support of the rack bottom 45. The protrusions 36 extend in substantially horizontal direction from the rack bottom, i.e. they extend in the plane of the rack bottom 45, towards the inside surface of the support frame 43. In the support frame 43, a guiding slot 37 positioned corresponding to each of the protrusions 36 of the rack bottom 45 is arranged. Each protrusion 36 is arranged in the corresponding guiding slot 37 in order to make it possible for the rack bottom to move between the two end positions of the slot 37. The movable rack bottom 45 is favorable since the rack bottom 45 will automatically move to the lowest position by gravity and thereby ensure that the maximum packing space within, and above, the cutlery rack 41 is ensured no matter which side of the cutlery rack that is facing upwards.

Figure 4:
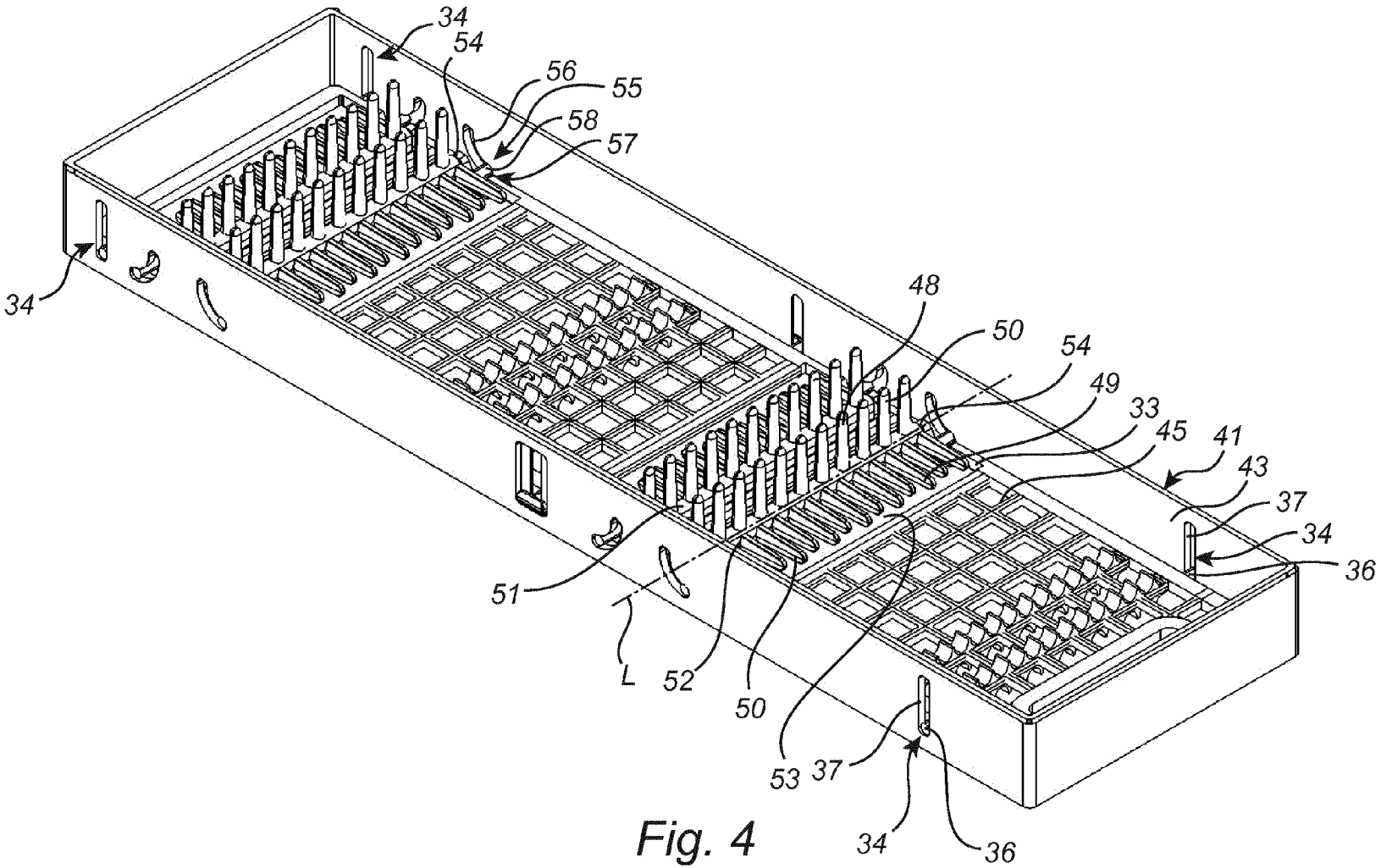
FIG. 4 illustrates a perspective view of a second embodiment of a cutlery rack.
Figure 5:
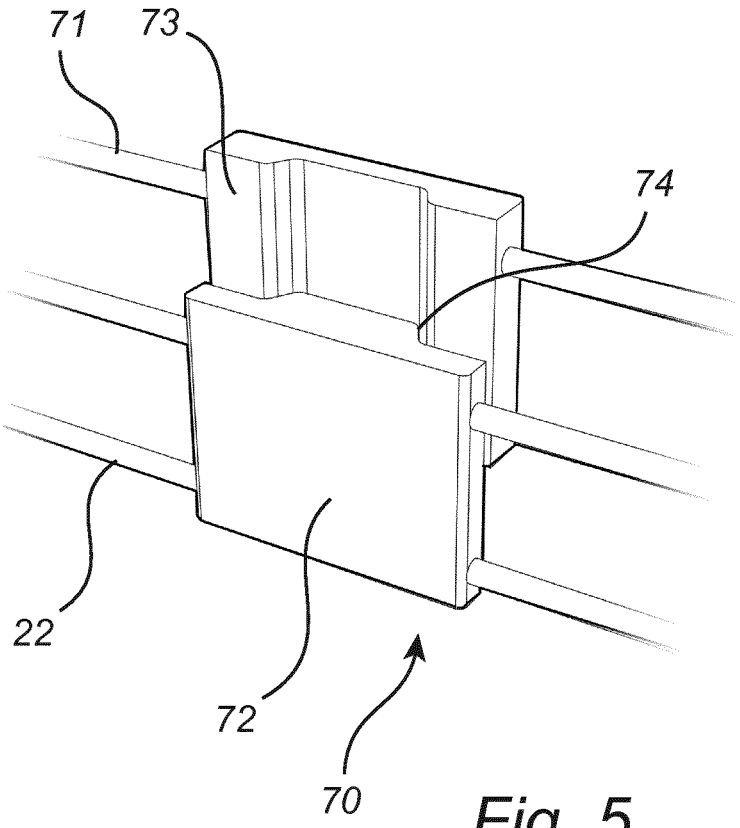
FIG. 5 illustrates a device for height adjustment of cutlery racks.

The cutlery rack illustrated in FIG. 4 furthermore comprises first 48 and second 49 support arrangements that are retractably arranged in the support frame 43, or rack bottom 45, such that said support arrangement that is facing downwards automatically is retracted to a position with reduced extraction from the rack bottom side facing downwards. In the illustrated cutlery rack, the retracted support arrangement is arranged substantially parallel to the rack bottom. The retracted support arrangement, on the side facing downwards, has the additional advantage that it makes it possible to use the space below the rack in a more efficient way.

The first 48 and second 49 support arrangements are embodied as tines 50 arranged in rows 51 extending between opposite sides of the rectangular support frame 43 substantially parallel to the side surfaces of the rectangular support frame 43. The number of rows depends on the size of the cutlery tray and the cutleries that will be packed in the cutlery rack.

In order for the support arrangements to be retractable, the tines 50 of the first 48 support arrangement extend in a first radial direction from an elongated member 52 arranged substantially parallel to the plane of the rack bottom 43 and the support frame 43 between opposite sides of the rectangular support frame 43 substantially parallel to the side surfaces of the rectangular support frame 43. Furthermore, the tines 50 of the second 49 support arrangement extend from the elongated member 52 in a second radial direction. The first and second radial direction is arranged substantially 90° from each other. This means that by turning the elongated member 52 approximately 90° around the longitudinal axis L of the elongated member 52, the first and second support arrangements could be arranged in either a position where they extend substantially perpendicularly upwards from the rack bottom 45, or arranged substantially parallel to, and preferably substantially in line with, the rack bottom 45.

The elongated member is arranged in a cut out portion 53 in the rack bottom 45. The cut out portion 53 has a shape corresponding to the dimensions of the first 48 and second 49 support element to make it possible to arrange the retracted support element in the cut out portion 53, in line with the rack bottom 45. The elongated member 52 is rotatably secured in the rack bottom 45 and move together with the rack bottom 45 along the vertical direction when the cutlery rack 41 is turned upside down. In the illustrated embodiment, each longitudinal end of the elongated member 52 is extending through a corresponding loop 54 formed in, or secured in, the rack bottom 45. The loop 54 is arranged transverse to the longitudinal axis L of the elongated member 52 close to the edge of the rack bottom 45 adjacent to the inside surface of the support frame 45 to provide a reliably and stable securing of the elongated member 52 to the rack bottom 45. The elongated member 52 preferably has a substantially circular cross section in the areas of the loops 54 to facilitate turning of the elongated member 52 within the loops 52.

The automatic turning of the elongated member 52, and the first 48 and second 49 support arrangements, when the cutlery rack 41 is flipped is achieved by turning means 55 arranged in at least one, an preferably both, of the longitudinal ends of the elongated member 52. The turning means 55 comprises an arc-shaped slot 56 arranged in the support frame 43 in the area of each of the ends of the elongated member 52, and a turning member 57.

The arc-shaped slot 56 has an angular length of approximately 90° to provide the desired 90° turning of the elongated member 52, and the first and second support arrangements, and thereby generate the desired retraction of the support arrangement on the side of the rack bottom 45 facing downwards.

The turning member 57 comprises a tap 58 extending substantially parallel to the longitudinal member 52 a short distance from the longitudinal axis L of the elongated member 52. The tap 58 is connected to the elongated by an arm 59 extending in substantially radial direction from the end of the elongated member 52. The arm 59 is arranged outside the loop 54 and inside the inside surface of the support frame 43, i.e. between the loop 54 and the inner surface of the support frame 43, without contact between the arm 59, the loop 54 and the inside surface of the support frame 43 to make it possible for the arm 59 to move together with the elongated member 52 and the tap 58. The tap 58 in combination with the curved slot 56 generates the turning movement of the elongated member 52, and the support arrangements, when the cutlery rack 41 is turned upside down and the rack bottom 45 moved in the vertical direction as described above since the elongated member 52 is secured in the rack bottom 45 while the tap 58 is guided within the arc-shaped slot 56 during the vertical movement of the rack bottom 45 which generates the desired turning movement of the elongated member 52.

In order to further improve the possibilities for the operator to adapt the interior design of the dishwasher to individual needs, means 70 for height adjustment of cutlery racks is illustrated in FIG. 6. This embodiment of the rectangular rack support 22 comprises one or more additional wire frames 71 with a size corresponding to the one or more cutlery racks that are intended to fit in the rack support 22. The size of each wire frame 71 is designed to correspond to the cutlery rack that will be fitted in the wire frame 71. The wire frame 71 is attached to the rack support 22 by at least two height adjustment means 70. Each height adjustment means 70 comprises a first part 72 attached in the rack support 22 and a second part 73 secured in the wire frame 71. The first and second parts are connected to each other by a male/female fitting 74. The male/female fitting ensures that the parts remain attached to each other but still enables the first and second part to slide in relation to each other and thereby adapt the vertical height of the support frame 71 in relation to the rack support 22. The selected position is maintained by the friction between the two parts of the male/female fitting. The possibility to adjust the vertical height of the cutlery rack supported on the wire frame is advantageous since the space underneath the cutlery rack is increased. The increased space under the cutlery rack could be used to pack higher or larger glasses, cups or pots in the basket arranged under the cutlery rack.

The different embodiments described above could all be combined and modified in different ways without departing from the scope of the invention that is defined by the appended claims.

The invention claimed is:

1. A cutlery rack for a dishwasher, said cutlery rack comprising:

a support frame surrounding a storage area;

a rack bottom with a first side and a second side, wherein the first side is defined on a reverse side of the rack bottom from the second side, such that the first side faces an opposite direction from the second side, and wherein only one of the first side and the second side is configured to face upwardly at a time;

a first support arrangement for cutleries arranged on the rack bottom, wherein the first support arrangement is configured to extend from the first side of the rack bottom; and a second support arrangement for cutleries arranged on the rack bottom; wherein the second support arrangement is configured to extend from the second side of the rack bottom, wherein the rack bottom is reconfigurable between a first configuration and a second configuration, wherein in the first configuration the first side is configured to face upwardly while the second side faces downwardly, and wherein in the second configuration the second side is configured to face upwardly while the first side faces downwardly;

wherein the rack bottom is movably arranged along a vertical direction within the support frame between a first position and a second position, wherein the first configuration of the rack bottom is configured to define the first position, wherein the second configuration of the rack bottom is configured to define the second position, and wherein the first position is different than the second position, such that when the rack bottom is reconfigured between the first configuration and the second configuration the vertical position of the rack bottom is changed.

2. The cutlery rack according to claim 1, wherein the support frame has a vertical centre and the rack bottom is arranged in the support frame offset to the vertical centre.

3. The cutlery rack according to claim 1, wherein the rack bottom is attached in the support frame by at least one guide and positioned in the lower position by gravity.

4. The cutlery rack according to claim 3, wherein each of the at least one guide comprises an elongated guiding slot and a corresponding protrusion that is able to slide within the slot, said slot is arranged in one of the support frame or the rack bottom and said protrusion is arranged in an opposite one of the support frame or the rack bottom.

5. The cutlery rack according to claim 1, wherein the first and second support arrangements are retractably arranged in the support frame or rack bottom and movable between a protruding position and a retracted position.

6. The cutlery rack according to claim 5, wherein the first and second support arrangements are extending from an elongated member turnable around a longitudinal axis of the elongate member substantially parallel to the rack bottom.

7. The cutlery rack according to claim 6, wherein the first support arrangement is configured to turn to an upright position when the first side is facing upwards, wherein the first support arrangement is configured to turn to a first retracted position aligned with the rack bottom when the first side is facing downwards, wherein the second support arrangement is configured to turn to an upright position when the second side is facing upwards, and wherein the second support arrangement is configured to turn to a second retracted position aligned with the rack bottom when the second side is facing downwards.

8. The cutlery rack according to claim 6, wherein turning means are arranged in at least one end of the elongated member, said turning means comprising an arc-shaped slot arranged in the support frame and a turning member connected to the elongated member, said turning member is sliding within the arc-shaped slot such that the elongated member is forced to turn when the cutlery rack is turned upside down.

9. The cutlery rack according to claim 1, wherein the first and second support arrangement have different configurations to support different types and sizes of cutleries.

10. The cutlery rack according to claim 1, wherein at least one of the first support arrangement or the second support arrangement comprises support elements arranged at a predetermined distance from each other and extending in a substantially vertical direction from the rack bottom.

11. The cutlery rack according to claim 5, wherein at least one of the first support arrangement or the second support arrangement comprises support elements arranged at a predetermined distance from each other and extending in a substantially vertical direction when in the protruding position.

12. The cutlery rack according to claim 10, wherein selected support elements are formed of an elastic material.

13. The cutlery rack according to claim 1, wherein the support frame comprises an inside and an outside, said rack bottom is arranged on the inside surface of the frame and a number of protruding support devices extending from the outside surface of the support frame.

14. Dishwasher comprising at least one cutlery rack according to claim 1 arranged in a rack support extractably arranged in the dishwasher.

15. The cutlery rack according to claim 11, wherein selected support elements are formed of an elastic material.

16. The cutlery rack according to claim 2, wherein in the first configuration, the rack bottom is disposed at a first height, wherein in the second configuration, the rack bottom is disposed at a second height, and wherein the first height is different than the second height.

17. The cutlery rack according to claim 6, wherein the first support arrangement is perpendicular to the second support arrangement.

18. The cutlery rack according to claim 8, wherein the rack bottom is configured to cause the turning member to slide in the arc-shaped slot when reconfigured between the first configuration and the second configuration, and the turning member is configured to cause the elongated member to rotate the first support arrangement and the second support arrangement when slid in the arc-shaped slot.

19. The cutlery rack according to claim 1, wherein the rack bottom is configured to be flipped relative to the support frame between the first configuration and the second configuration.

20. A cutlery rack for a dishwasher, said cutlery rack comprising:

a support frame surrounding a storage area;

a rack bottom with a first side and a second side, wherein the first side is defined on a reverse side of the rack bottom from the second side, such that the first side faces an opposite direction from the second side, and wherein only one of the first side and the second side is configured to face upwardly at a time;

a first support arrangement for cutleries arranged on the rack bottom, wherein the first support arrangement is configured to extend from the first side of the rack bottom; and a second support arrangement for cutleries arranged on the rack bottom; wherein the second support arrangement is configured to extend from the second side of the rack bottom, wherein the rack bottom is reconfigurable between a first configuration and a second configuration, wherein in the first configuration the first side is configured to face upwardly while the second side faces downwardly, and wherein in the second configuration the second side is configured to face upwardly while the first side faces downwardly, wherein the rack bottom is movably arranged along a vertical direction within the support frame between a first and a second position, wherein the first configuration of the rack bottom is configured to define the first position, wherein the second configuration of the rack bottom is configured to define the second position, and wherein the first position is different than the second position, such that when the rack bottom is reconfigured between the first configuration and the second configuration the vertical position of the rack bottom is changed.

* * * * *